US009051039B1

(12) United States Patent
Poorbaugh

(10) Patent No.: US 9,051,039 B1
(45) Date of Patent: Jun. 9, 2015

(54) TROLLING MOTOR STAND

(71) Applicant: RM Industries, Inc., Kansas City, KS (US)

(72) Inventor: Michael L. Poorbaugh, Lakeland, FL (US)

(73) Assignee: RM Industries, Inc., Kansas City, MO (US)

( * ) Notice: Subject to any disclaimer, the term of this patent is extended or adjusted under 35 U.S.C. 154(b) by 0 days.

(21) Appl. No.: 14/177,953

(22) Filed: Feb. 11, 2014

(51) Int. Cl.
*B23Q 3/00* (2006.01)
*B63H 20/06* (2006.01)

(52) U.S. Cl.
CPC ..... *B63H 20/06* (2013.01)

(58) Field of Classification Search
CPC ..... B62B 1/00; B65G 37/00; B23Q 3/00; B60R 9/00; E04H 4/14; B65D 85/68
USPC ..... 248/688, 371, 154, 146, 176.1, 180.1, 248/181.2, 187.1, 640, 641, 302, 303, 304, 248/305, 306, 307, 188.2, 346.01, 346.03, 248/346.04, 152, 500; 405/1, 3, 7; 280/47.13, 47.19, 79.1, DIG. 2; 211/13.1, 23, 24; 114/44, 45, 343; 108/55.1, 57.17
See application file for complete search history.

(56) References Cited

U.S. PATENT DOCUMENTS

| | | | | | |
|---|---|---|---|---|---|
| 529,939 | A * | 11/1894 | Noderer | 211/20 |
| 2,266,683 | A * | 12/1941 | Berglund | 248/640 |
| 2,380,017 | A * | 7/1945 | Blicker | 280/79.3 |
| 2,646,237 | A * | 7/1953 | Hinesman | 248/640 |
| 2,686,028 | A * | 8/1954 | Johnson | 248/643 |
| 2,966,319 | A * | 12/1960 | Todish et al. | 248/640 |
| 3,045,851 | A * | 7/1962 | Rupert | 414/621 |
| 3,473,764 | A * | 10/1969 | Hopper | 248/641 |
| 4,044,978 | A * | 8/1977 | Williams | 248/640 |
| 4,073,462 | A * | 2/1978 | Whitaker | 248/537 |
| 4,366,954 | A * | 1/1983 | Cash et al. | 269/289 R |
| 4,570,960 | A * | 2/1986 | Peetz | 280/47.131 |
| 5,020,708 | A * | 6/1991 | Kalbach | 224/42.32 |
| 5,320,324 | A * | 6/1994 | Norton | 248/640 |
| 5,566,960 | A * | 10/1996 | McCrory | 280/47.35 |
| 5,680,931 | A * | 10/1997 | Hashimoto et al. | 206/319 |
| 5,792,312 | A * | 8/1998 | Dotterman et al. | 156/579 |
| 5,884,885 | A * | 3/1999 | Schmidt, Jr. | 248/346.01 |
| 6,364,277 | B1 * | 4/2002 | Miller | 248/676 |
| 6,471,180 | B1 * | 10/2002 | Cunningham | 248/640 |
| 6,585,224 | B1 * | 7/2003 | Schmidt | 248/640 |
| 6,789,807 | B2 * | 9/2004 | Morrison et al. | 280/47.19 |
| 6,835,883 | B2 * | 12/2004 | Stevens | 84/453 |
| 7,140,148 | B1 * | 11/2006 | Williams, II | 43/54.1 |
| 7,628,360 | B2 * | 12/2009 | Anthes et al. | 248/125.8 |
| 7,661,240 | B2 * | 2/2010 | Sargent | 52/677 |
| 7,819,366 | B2 * | 10/2010 | Paga et al. | 248/110 |
| 7,900,881 | B2 * | 3/2011 | Campagna | 248/153 |
| D660,614 | S * | 5/2012 | Palmeiri | D6/449 |
| 8,485,369 | B2 * | 7/2013 | Glover | 211/24 |
| 2008/0251660 | A1 * | 10/2008 | Spyker | 248/176.1 |
| 2009/0044739 | A1 * | 2/2009 | Imel et al. | 114/263 |
| 2009/0100589 | A1 * | 4/2009 | Peterson et al. | 4/509 |

* cited by examiner

*Primary Examiner* — Nkeisha Smith
(74) *Attorney, Agent, or Firm* — Lathrop & Gage LLP

(57) ABSTRACT

An apparatus for supporting upright a trolling motor, the apparatus comprising a base, at least one housing extending upwardly from the base, the at least one housing for receiving and supporting a lower unit of a trolling motor. The apparatus further includes a plurality of openings disposed adjacent the housing, and a stabilizing arm with a first end and a second end, the first end of the stabilizing arm for receipt into one of the plurality of openings and the second end for stabilizing a shaft of the trolling motor. When a trolling motor lower unit is positioned atop the housing and the shaft of the trolling motor is positioned within the second end of the stabilizing arm the trolling motor is stabilized in an upright position.

17 Claims, 4 Drawing Sheets

TROLLING MOTOR STAND

BACKGROUND OF THE INVENTION

Field of the Invention

According to the U.S. Fish and Wildlife Service in 2006, 30 million U.S. residents 16 years and older went fishing. These fishermen spend over $9.7 billion per year on gear and accessories associated with the sport. In addition, the average amount anglers spend yearly on hooks, rods, lures and other fishing equipment increased 16 percent from 2001 to 2006. Clearly, fishing continues to be a favorite pastime in the United States.

Trolling motors are an essential component of the fishing equipment of many anglers, and the trolling motors are expensive. Unfortunately, many trolling motors are improperly stored when not in use and are inadvertently damaged during storage. Because trolling motors are unwieldy in their configuration they can present a considerable challenge to store in a manner safe from damage. Of particular concern is the prospect of the trolling motor slipping when leaned against a vertical surface, such as a wall. If the trolling motor plastic control housing impacts a hard surface, such as a garage floor, the motor is generally irreparably damaged. Additionally, it is important to protect the prop of the trolling motor, which typically is plastic, from damage through impact during storage. Elevating the prop off of the floor and placing the lower unit in a secure nest substantially reduces the prospect of damage of that critical component of the trolling motor.

Damage to the trolling motors can arise from many scenarios but common situations occur when the motor is propped up against a wall and children, adults or pets inadvertently trip over or impact the prop or lower unit. Additionally, when the motor is improperly stored by leaning it against a vertical surface or some other support surface any component of the motor such as the control housing, the shaft or the lower unit may be impacted by an obstacle such as a soccer ball, a baseball or other hard object that can transfer sufficient enough energy to the unstably positioned trolling motor to cause the portion of the unit resting on the floor, generally the prop, to slip. This scenario generally leads to the control housing impacting the floor and damaging the plastic housing.

One storage option that has resulted is to hang a cable or a bracket from the ceiling and to suspend the trolling motor by the housing or some other component. This form of storage can present considerable obstacles to safe storage of the motor. Many components on the trolling motor are not designed with sufficient structural rigidity to be suspended by a cable, rope or bracket and could in turn result in damage to the motor. Additionally, finding a location in a garage or storage area that facilitates the securing of a cable or bracket suspended from the ceiling can be problematic due to limited space availability and/or high ceilings. Consequently, the use of trolling motor suspension options provide less than desirable alternatives to the proposed technology.

Accordingly, there exists a need for a trolling motor stand, which may be easily configured to secure a trolling motor during storage. Further, the storage apparatus would serve to cradle the entire trolling motor to prevent inadvertent slippage of the motor thereby avoiding potential damage to the control housing and/or the prop.

SUMMARY

In view of the foregoing disadvantages inherent in the prior art, the general purpose of the present apparatus is to provide a stand for securing a trolling motor against damage during storage configured to include all the advantages of the prior art, and to overcome the drawbacks inherent therein.

Another object of the present invention is to provide a portable trolling motor storage apparatus which may be easily reconfigured by a user to accommodate varying sizes of trolling motors. In light of the above objects, in one aspect of the present invention, a portable trolling motor storage apparatus to protect the motors from inadvertent damage during storage is disclosed.

The trolling motor storage apparatus comprises a base plate and a cradle for supporting a motor housing of a trolling motor extending substantially perpendicularly upwardly from the base plate. In addition, the apparatus includes a stabilizing arm extending upwardly from the saddle, the stabilizing arm further comprising a U-shaped support member wherein when a trolling motor lower unit is positioned within the cradle and the trolling motor shaft is received within the U-shaped support member the trolling motor is fully stabilized in an upright position.

These together with other aspects of the present invention, along with the various features of novelty that characterize the present invention, are pointed out with particularity in the claims annexed hereto and form a part of this present invention. For a better understanding of the present invention, its operating advantages, and the specific objects attained by its uses, reference should be made to the accompanying drawings and descriptive matter in which there are illustrated exemplary embodiments of the present invention.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Embodiments of the present invention provide an apparatus for securely storing a trolling motor in an upright position when not in use aboard a fishing boat. To provide context for the disclosed embodiments, consider FIGS. 1-7 which detail the preferred embodiment of the design.

Figure 1:
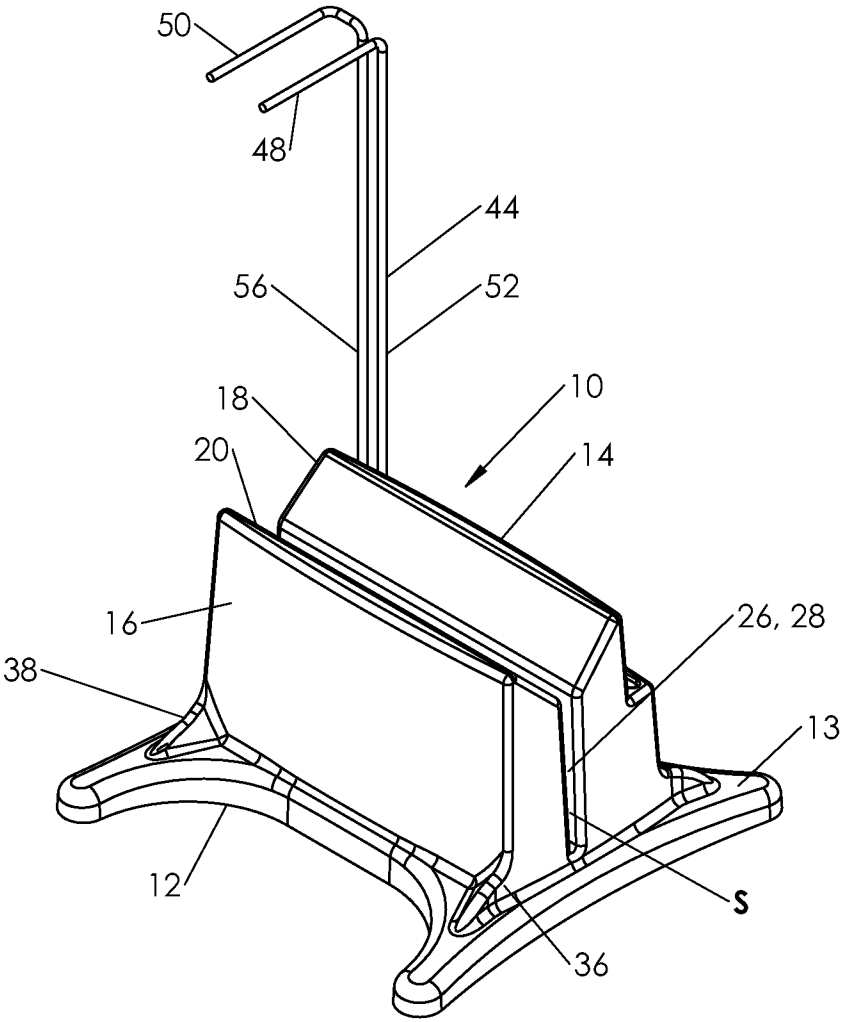
FIG. 1 is a perspective view of the trolling motor storage apparatus.
Figure 5:
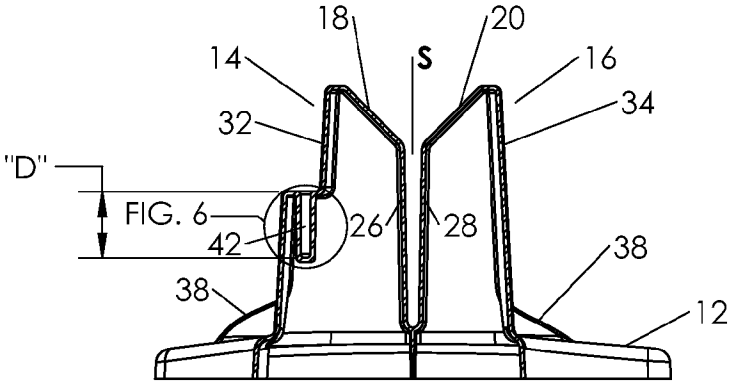
FIG. 5 is a cross sectional view of the trolling motor storage apparatus taken along line 5-5 of FIG. 4.

The trolling motor storage apparatus as shown in a perspective view at FIG. 1 is configured for placement on a rigid horizontal surface such as a garage floor or the floor of a storage room. The trolling motor storage apparatus 10 includes a base 12 with outwardly extending feet 13 that provide stability to the base 12 and prevent tipping of the apparatus particularly when a trolling motor is in position on the apparatus. As best seen in FIG. 5, extending upwardly from the base 12 are two closely spaced housings 14, 16. The housings are preferably molded from an engineering plastic such as polypropylene and preferably are hollow to limit the weight of the unit; however, solid housings remain an optional configuration.

The upper most segments, or landings, 18, 20, as seen in FIG. 1, form the saddle that cradles the lower unit 22 of the trolling motor 24 when it is positioned atop the storage apparatus 10. As further seen in FIGS. 3 and 5, the landings 18, 20 are preferably downwardly canted at an angle of from 30 to 60 degrees. A downward cant of 45 degrees produces a cradle that effectively supports the lower unit 22 and limits the rotation of the trolling motor 24.

Figure 3:
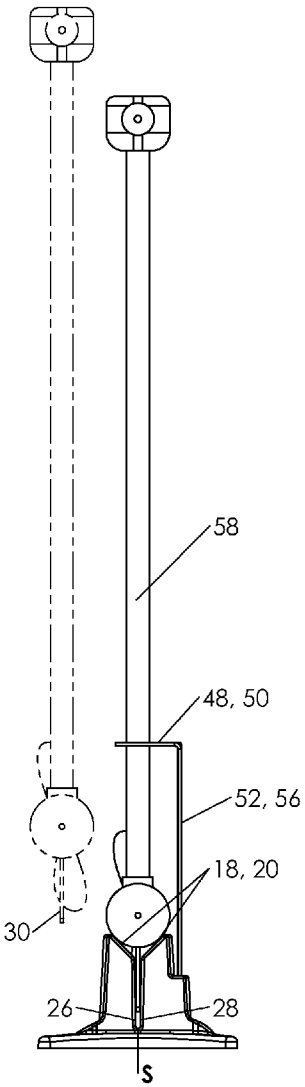
FIG. 3 is a side elevation view of a trolling motor in phantom before being positioned within the storage apparatus and a solid line view of a trolling motor positioned within the nest of the storage apparatus.
Figure 2:
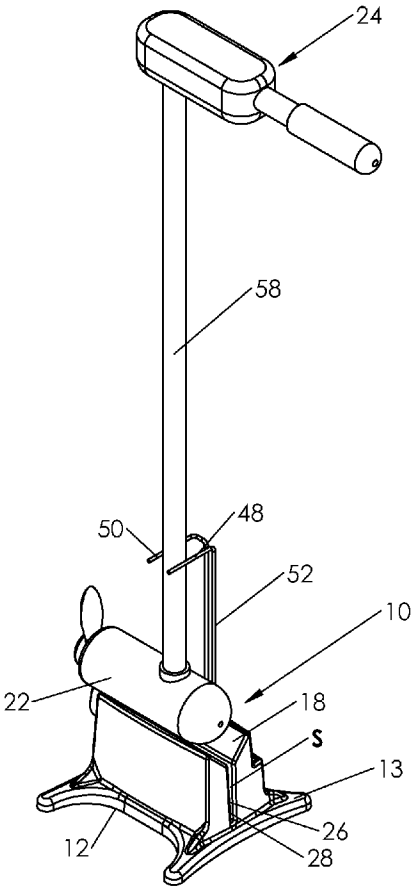
FIG. 2 is a perspective view of the trolling motor storage apparatus with a trolling motor positioned within the nest of the apparatus.

The housings 14, 16 as seen in FIGS. 3 and 5 are closely spaced and have walls 26, 28 that face one another. These walls 26, 28 extend upwardly from the base 12 an amount sufficient to receive the full length of the rudder 30, typically no more than 5 inches. The spacing "S" between the walls 26, 28 is likewise sufficient to receive a wide range of rudders from various brands of trolling motors and preferably the spacing is in the range of from 0.25 to 0.45 inches.

As seen in FIG. 5, the housings 14, 16, also include exterior walls 32, 34 that provide structural support to the landings 18, 20. The exterior walls 32, 34 facilitate the transfer of the weight of the trolling motor to the base so that the entire trolling motor weight is not supported by the closely spaced face plates 26, 28.

To further increase structural rigidity of the storage apparatus the exterior walls 32, 34 are further reinforced at the corners 36 of the base 12 with gussets 38. These gussets serve to reinforce the exterior walls 32, 34 against bowing and fracture when the load of the trolling motor 24 is positioned atop the housing landings 18, 20. The gussets are intended to limit the rotation of the exterior walls 32, 34 when a load is applied and consist of additional material added to the housings 14, 16 at the corners 36.

Figure 7:
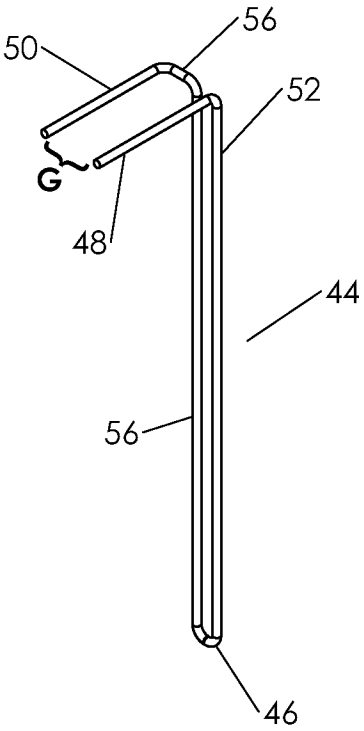
FIG. 7 is a perspective view of the stabilizing arm.

On the lateral side 40 of the first housing 14 are a series of pockets 42 sized for receiving the stabilizing arm 44 of the storage apparatus. The stabilizing arm 44 is preferably comprised of a single gauge of metal wire with a nominal diameter in the range of from 0.150 to 0.20 inches and preferably 0.188 inches. The wire is preferably comprised of steel; however, alternatives such as aluminum may also be utilized. As seen with FIG. 7, a single length of wire is preferably utilized to form the stabilizing arm 44 with a "U" shaped bend 46 at the lower extremity and two inwardly extending fingers 48, 50 at the upper extremity of the stabilizing arm 44. The stabilizing arm is preferably in the range of from 12 to 16 inches in length from the "U" shaped bend 46 at the lower extremity to the inwardly extending fingers 48, 50. Stabilizing arms 44 of this length provide sufficient support to the shaft of a trolling motor to prevent rotation of the motor 24 out of the storage apparatus 10. The first finger 48 runs directly inwardly, toward the shaft of the trolling motor, from the first upwardly extending span 52 of wire. The second inwardly extending finger 50 is further separated from the first finger 48 by a longitudinally extending segment 56 of wire. The separation distance or gap "G" between the first and second fingers 48, 50, as seen in FIG. 7, is preferably in the range of 1 to 2 inches and further preferably about 1.5 inches.

The first and second fingers 48, 50 extend inwardly from the first and second upwardly extending spans of wire 52, 54 approximately 3 to 4 inches or an amount sufficient to extend over the gap "S" between the two closely spaced walls 26, 28. With the fingers 48, 50 extending over the gap "S" they are capable of preventing rotation of the shaft of the trolling motor.

Figure 6:
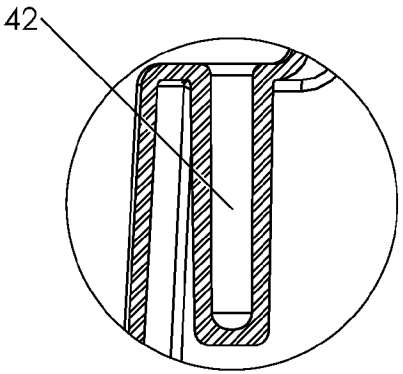
FIG. 6 is a magnified view of the highlighted detail in FIG. 5.
Figure 4:
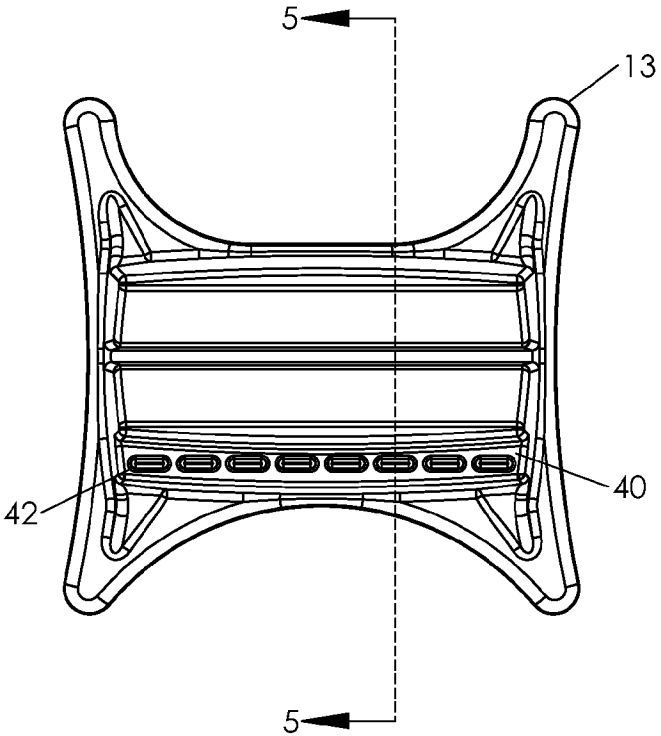
FIG. 4 is a plan view of the trolling motor storage apparatus.

As previously indicated, and as seen in FIGS. 4-6, on the lateral side 40 of the first housing 14 is a plurality of pockets 42 capable of receiving the U-shaped bend 46 in the stabilizing arm 44. The first housing 14 preferably includes between 6 and 10 longitudinally disposed pockets 42 to facilitate repositioning of the stabilizing arm 44 to accommodate a wide range of trolling motor sizes and configurations. The pockets 42 are preferably 0.75 to 0.80 inches in width and receive and hold the U shaped bend 46 of the stabilizing arm 44 in a snug manner to prevent inadvertent release of the stabilizing arm from the pocket 42. The pockets are preferably 1.0 to 1.5 inches in depth "D" to provide sufficient stability 44 and prevent rotation of the arm 44. The stabilizing arm 44 can; however, readily be extracted from the pocket 42 with minimal effort by the user so that it can be repositioned, as necessary, to accommodate a trolling motor of a different configuration.

As best seen in FIG. 3, in operation, the user of the trolling motor will remove the motor from the fishing vessel and transport it to a secure location for storage. When in proximity to the storage apparatus 10, the user will elevate the rudder 30 of the lower unit 22 above the housing landing surfaces 18, 20 and slide the rudder 30 into the gap "S" between the closely spaced face plates 26, 28. The placement of the rudder 30 into the gap "S" will coincide with the placement of the trolling motor shaft 58 into the gap "G" between the fingers 48, 50 as seen in FIG. 7. Once in position as described immediately above, the trolling motor lower unit 22 is cradled atop the housing landings 18, 20 and the rudder 30 is securely received into the gap spacing "S" between the walls 26, 28. The trolling motor shaft 58 is secured in position between the fingers 48, 50 of the stabilizing arm 44 thereby preventing forward/backward rotation of the trolling motor.

The trolling motor can be quickly removed from the storage apparatus 10 by lifting the trolling motor 24 straight up and off of the housing landings 18, 20 so that the rudder 30 is no longer bounded by the housing landings 18, 20 and then laterally moving the trolling motor shaft 58 away from the fingers 48, 50. Once the rudder 30 is free from the housing landings 18, 20 and the shaft 58 is free of the fingers 48, 50 the trolling motor is no longer constrained by the storage apparatus 10.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and sub combinations are of utility and may be employed without reference to other features and sub combinations and are contemplated within the scope of the claims. Not all steps listed in the various figures need be carried out in the specific order described.

The invention claimed is:

1. An apparatus for supporting a trolling motor, the apparatus comprising:

a base;

at least one housing extending upwardly from the base, the at least one housing for receiving and supporting a lower unit of a trolling motor;

a plurality of openings disposed adjacent the housing; and a stabilizing arm with a first end and a second end, the first end of the stabilizing arm including a U-shaped bend for receipt into one of the plurality of openings and the second end of the stabilizing arm extending outwardly over the at least one housing for stabilizing a shaft of the trolling motor, wherein when a trolling motor lower unit is positioned atop the at least one housing and the shaft of the trolling motor is positioned within the second end of the stabilizing arm the trolling motor is stabilized in an upright position.

2. The apparatus of claim 1, wherein the at least one housing is further comprised of a least two closely spaced housings extending upwardly from the base.

3. The apparatus of claim 2, wherein the at least two closely spaced housings each include an upper surface and each upper surface is canted downwardly toward the opposing housing creating a cradle for placement of the lower unit of the trolling motor.

4. The apparatus of claim 2, wherein the closely spaced housings are separated by a distance in the range of from 0.25 and 0.75 inches.

5. The apparatus of claim 4, wherein when the apparatus is in use a rudder secured to a trolling motor lower unit is inserted between the closely spaced housings.

6. The apparatus of claim 1, wherein the base and housing are further comprised of an engineered plastic.

7. The apparatus of claim 1, wherein the plurality of openings disposed adjacent the housing comprises at least three openings for receipt of the U-shaped bend of the first end of the stabilizing arm.

8. An apparatus supporting upright a trolling motor, the apparatus comprising:

a base;

at least two closely spaced housing members extending substantially perpendicularly from the base, the at least two closely spaced housing members further comprising upper surfaces canted downwardly toward the opposing housing member thereby creating a Y-shaped configuration;

at least one opening in one of the at least two closely spaced housing members; and a detachable stabilizing arm with a first end and a second end, the first end for receipt into the at least one opening, the second end extending upwardly from the first end and terminating in at least two inwardly extending fingers, wherein a rudder of the trolling motor is inserted between the closely spaced housing members and the shaft of the trolling motor is positioned into the at least two inwardly extending fingers thereby stabilizing the trolling motor against rotation.

9. The apparatus of claim 8, wherein the at least two closely spaced housing members are fabricated from an engineered plastic.

10. The apparatus of claim 9, wherein the at least two closely spaced housing members are fabricated from polypropylene.

11. The apparatus of claim 8, wherein the second end of the stabilizing arm extends upwardly from the first end in the range of from 8 to 12 inches before extending inwardly.

12. The apparatus of claim 8, wherein the at least two inwardly extending fingers are separated by a distance in the range of from 1.0 to 2.0 inches.

13. The apparatus of claim 8, wherein the canted upper surfaces of the at least two closely spaced housing members are downwardly canted at an angle in the range of from 30 to 60 degrees from level.

14. The apparatus of claim 8, wherein the detachable stabilizing arm is comprised of wire with a diameter in the range of from 0.175 to 0.195 inches.

15. The apparatus of claim 8, wherein the closely spaced housings are separated by a distance in the range of from 0.25 to 0.75 inches.

16. The apparatus of claim 8, wherein the width of the at least one opening in the closely spaced housing is in the range of from 0.775 to 0.80 inches.

17. The apparatus of claim 8, wherein the detachable stabilizing arm is comprised of a steel alloy wire.

* * * * *